United States Patent [19]

Swingley, Jr.

[11] Patent Number: 4,499,997

[45] Date of Patent: Feb. 19, 1985

[54] TOTE BOX

[75] Inventor: Harold E. Swingley, Jr., Monona, Wis.

[73] Assignee: Menasha Corporation, Neenah, Wis.

[21] Appl. No.: 469,439

[22] Filed: Feb. 24, 1983

[51] Int. Cl.[3] ..... B65D 21/02; B65D 25/06

[52] U.S. Cl. ..... 206/509; 206/427; 217/31; 220/21; 220/22; 220/22.3; 220/72; 220/DIG. 9; 220/DIG. 15

[58] Field of Search ..... 206/509, 427; 220/21, 220/22, 22.3, DIG. 15, 72, DIG. 6; 217/31

[56] References Cited

U.S. PATENT DOCUMENTS

| | | | |
|---|---|---|---|
| 1,528,341 | 3/1925 | Navarro | 217/31 |
| 2,788,912 | 4/1957 | Simonsen | 220/22.3 |
| 3,120,413 | 2/1964 | Scotti | 217/31 |
| 3,203,612 | 8/1965 | Schaefer | 217/31 |
| 3,353,704 | 11/1967 | Belcher | 220/22 |
| 3,414,156 | 12/1968 | Felldin . | |
| 3,704,808 | 12/1972 | Gibson et al. . | |
| 3,902,599 | 9/1975 | Stromberg | 220/72 |
| 3,941,301 | 3/1976 | Jorgensen . | |
| 3,942,837 | 3/1976 | Engle | 217/31 |
| 4,042,142 | 8/1977 | Ruano . | |
| 4,062,166 | 12/1977 | Debaigt . | |
| 4,261,465 | 4/1981 | Thomas . | |
| 4,293,073 | 10/1981 | Yates | 220/74 |

FOREIGN PATENT DOCUMENTS

| | | | |
|---|---|---|---|
| 1272174 | 8/1961 | France | 206/509 |
| 7604727 | 2/1976 | France | 220/22 |
| 987850 | 3/1965 | United Kingdom | 206/509 |
| 1544631 | 4/1979 | United Kingdom | 220/21 |

*Primary Examiner*—George E. Lowrance
*Attorney, Agent, or Firm*—Quarles & Brady

[57] ABSTRACT

An improved tote box especially adapted for use within an automated storage and retrieval system is provided with a bumper rim a short distance from the tote bottom to reduce the moment arm created when the box engages another box or the like. Stacking stops are integrated with the bumper rim to provide additional strength, and the stops circumscribe side drains to allow fluid to be drained without flowing into a lower box in a stack. A divider grid is provided and includes intersecting crosswise and lengthwise divider plates, each Z-shaped and each having mounting slots in one edge and notches in the other. When the plates are mated by seating the slot of a lengthwise plate in the slot of a crosswise plate, the opposing bosses at the mouth of each slot of each plate seat in the notch of an intersecting plate. Tabs on each end of each plate seat in slots in the tote box walls and a ramp overlying the notch restrains the divider plate tab to secure the grid in the tote box.

9 Claims, 9 Drawing Figures

FIG.4
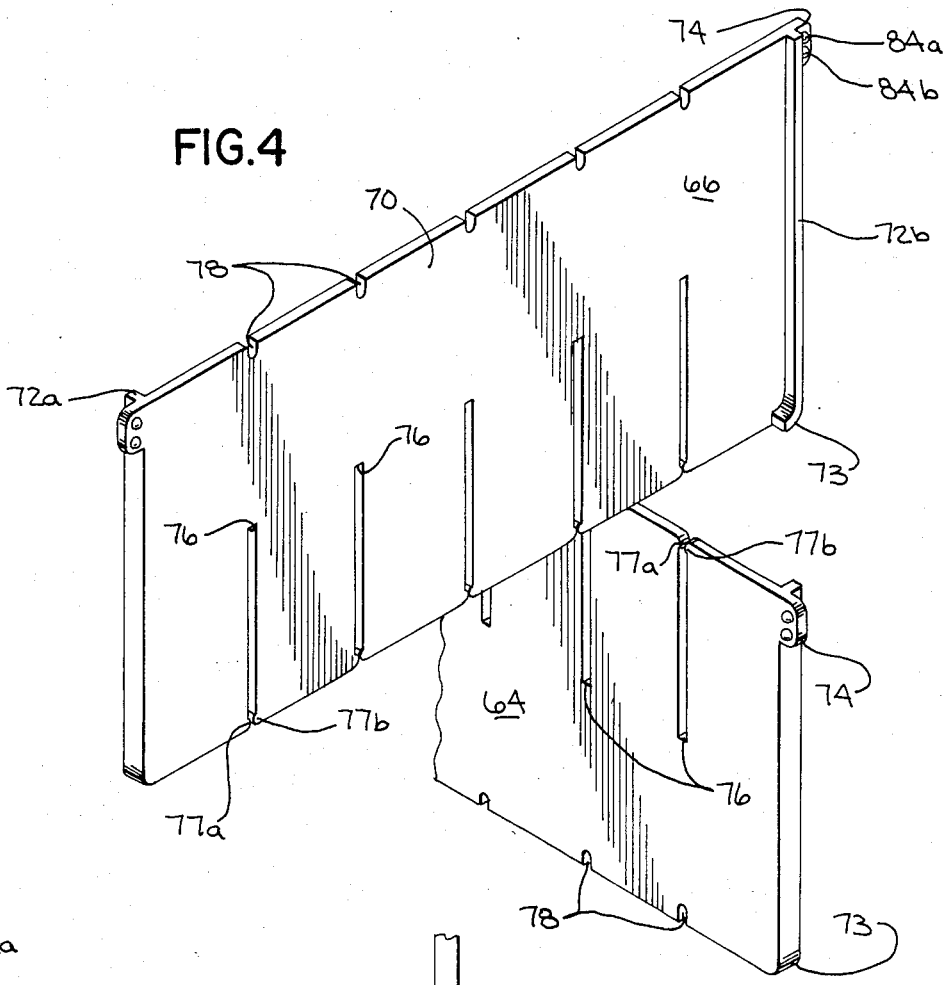
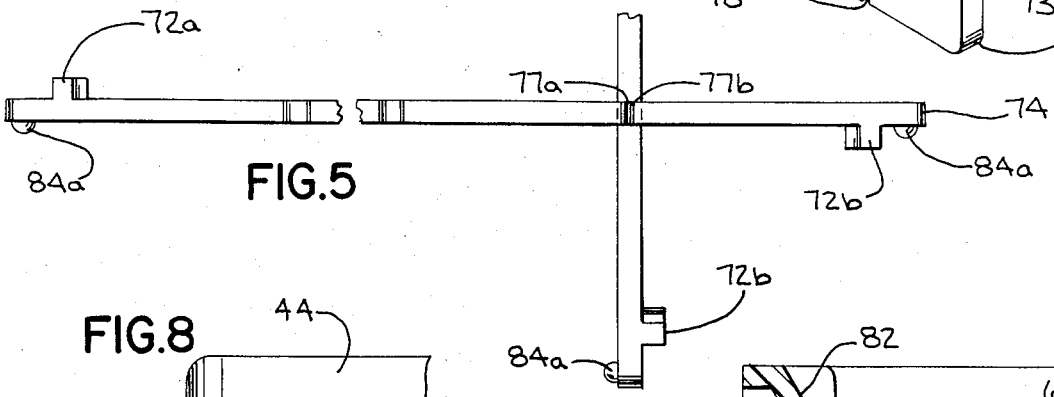
FIG.5
FIG.8
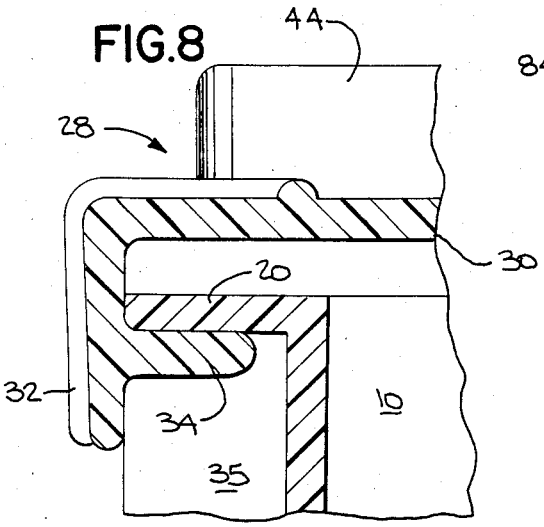
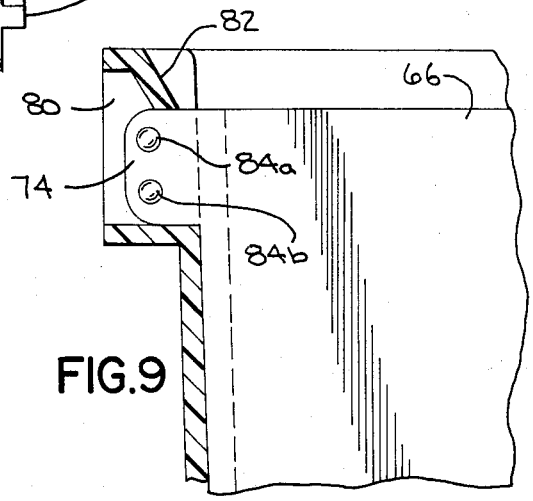
FIG.9

TOTE BOX

BACKGROUND OF THE INVENTION

This invention relates to a tote box especially adapted for use within an automated storage and retrieval material handling system.

Tote boxes are widely used for material handling applications for carrying raw materials, work in process or finished manufacturing goods. Typically, present day tote boxes are of molded plastic construction. While various tote box configurations are available, present day tote boxes do not lend themselves very well to use in an automated storage and retrieval system. Usually, present day tote boxes have an upper rim which defines the greatest outward lateral extension of the tote box. As a result, abutment of two or more like boxes, as they move along the conveyor of the automated storage and retrieval system, occurs at the rims. Since the rim is at the upper edge of the box, a large moment arm is created upon contact to the boxes making damage to the boxes, or more importantly their contents, more likely.

To conserve on floor space, present day tote boxes are often stacked one on top of another. To facilitate such stacking, the tote box is provided with stacking stops near the bottom so that the stacking stops of an upper tote box rest on the side walls of the lower tote box to enable stacking of the boxes whether or not the lower box has a lid. Even where the lower box carries a lid, the stacking stops on the upper box are nevertheless useful as the stacking stops allow the weight of the upper box to be concentrated at or near the edges of the lid material rather than on the lid center, which can be important when the lid is of a relatively thin material. Stacking stops on present day plastic tote boxes are usually not very strong and tend to break or bend, thus requiring an otherwise undamaged tote box to be discarded.

Another problem associated with present day tote boxes arises when, for example, a stack of unlidded boxes is exposed to the elements during external storage, or to water from an automatic sprinkler system or the like in the event of a fire. Water entering the top tote box increases the weight of the box and might cause the stack of boxes to topple or cause serious damage to the entire framework of an automated system. Draining of at least most of the water is important, not only to minimize damage to the contents of the box but also to reduce the extra weight due to the water. Simply allowing the water to flow from the top box into a lower box does not relieve the problem, and may in fact compound it since several boxes in the stack may then be filled with water.

To enable present day plastic tote boxes to transport very small articles, a divider grid is received within the tote box to create a plurality of small compartments, each accommodating a small article so as to segregate different small items. Conventional divider grid arrangements have not proved fully satisfactory from the standpoint of overall strength and ease of use. Moreover, present day divider grids suffer from the drawback that the divider plates lack rigidity so that the divider grid may not always maintain the proper orientation.

BRIEF SUMMARY OF THE INVENTION

Briefly, in accordance with the preferred embodiment of the invention, an improved tote box especially adapted for use within an automated storage and retrieval system comprises a bottom wall and opposing side walls and opposing end walls which each extend outwardly and upwardly from the bottom wall to form a boxlike structure having an opening in its top. A bumper rim extends outwardly from the opposing side and end walls of the box to circumscribe the outer box periphery. The bumper rim is located a short distance up from the box bottom wall so that the moment arm created when the bumper rim of the box is abutted by the bumper rim of a like box is kept small to reduce the likelihood of the box becoming dislodged off of the conveyor of an automated storage and retrieval system. The bumper rim may also serve to locate the tote box within a tote box carrying tray and maintain the tote box firmly within the tray. Further, the bumper rim can be located at the same level for tote boxes of various heights, which facilitates automated handling in that the system can grasp or contact the box properly regardless of box height. Integrated to the bumper rim are a plurality of stacking stops. The stops are also each integrated to, and extend outwardly from, a separate one of the opposing side walls of the tote box to afford greater strength to the stops. The stacking stops of each box abut the top of the side walls of a like box when the tote boxes are stacked one within another so as to prevent jamming of the tote boxes. To eliminate the possibility of water accumulating in the box, a drain outlet is disposed through at least one stacking stop so that any water within the box is carried away through a trough formed by the stacking stop.

The interior of the tote box of the present invention is subdivided by an improved divider grid comprised of intersecting lengthwise and crosswise divider plates. Both the crosswise and lengthwise divider plates are "Z"-shaped, that is to say each plate has a central body and a pair of flanges each extending normally from each edge of the body section opposite to the other flange to impart rigidity to the divider plate. The ribs on the divider plates also serve to impart additional strength to the tote box walls when the assembled divider grid, formed by the intersecting divider plates, is seated in the tote box. Because the "Z" shaped divider plates are symmetrical, they may be inserted in either way. At the end of each divider plate is an outwardly extending mounting tab in a plane parallel to the main plane of the divider plate. When the assembled divider grid is received within the tote box, each tab is snapped into a corresponding slot in the tote box side wall. The tab is guided by an angled ramp overlying the slot opening. The ramp also restrains the divider tab within the slot to assure that the divider grid is secured within the tote box.

BRIEF SUMMARY OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIG. 4 is an exploded perspective view of one of the crosswise and lengthwise plates of the divider grid of FIG. 1;

FIG. 5 is a plan view of the crosswise and lengthwise divider plates of FIG. 4;

FIG. 8 is a cross sectional view taken along lines 8—8 of FIG. 3 illustrating the details of the lid hooks; and FIG. 9 is a partial view of the tote box of FIG. 2 illustrating the detail of the resilient flaps overlying the tote box rim notches.

DETAILED DESCRIPTION OF THE PREFERRED EMBODIMENT

Figure 1:
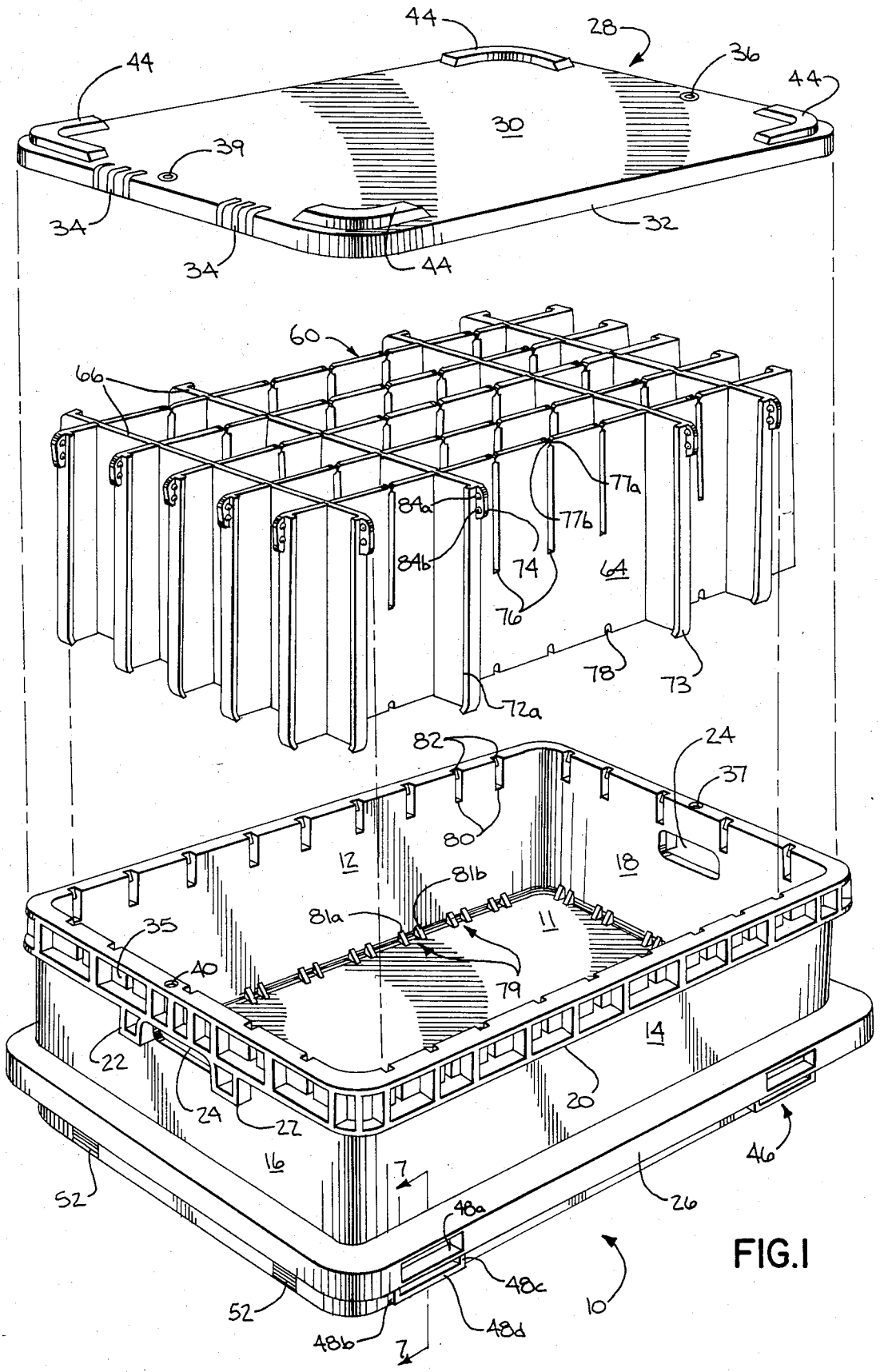
FIG. 1 is an exploded perspective view of the improved tote box of the present invention including the improved divider grid.

The figures, and especially FIG. 1, illustrate an improved tote box 10 which is comprised of a bottom wall 11 and a pair of opposing side walls 12 and 14 and a pair of opposing end walls 16 and 18 which extend upwardly from a separate one of the side and edges of bottom wall 11. The juncture of the side walls 12 and 14 and the end walls 16 and 18 with the bottom wall 11 are suitably radiused. Box 10 is typically manufactured by injection molding of a suitable plastic so that the bottom wall 11, the side walls 12 and 14 and the end walls 16 and 18 are integrally joined to one another. A rim 20 is integrated to, and projects normally from, each of the side walls 12 and 14 and the end walls 16 and 18 adjacent to the upper edge of each wall so as to extend about the periphery of the top of the tote box 10. Two pairs of spaced apart hand guards 22 are integrated to, and depend from, the rim 20 running along end walls 16 and 18 (only the pair along wall 16 being shown). Each of end walls 16 and 18 has an opening 24 therethrough located between the spaced apart hand guards to create a hand hold to enable manual lifting and transporting of the tote box as required.

Figure 2:
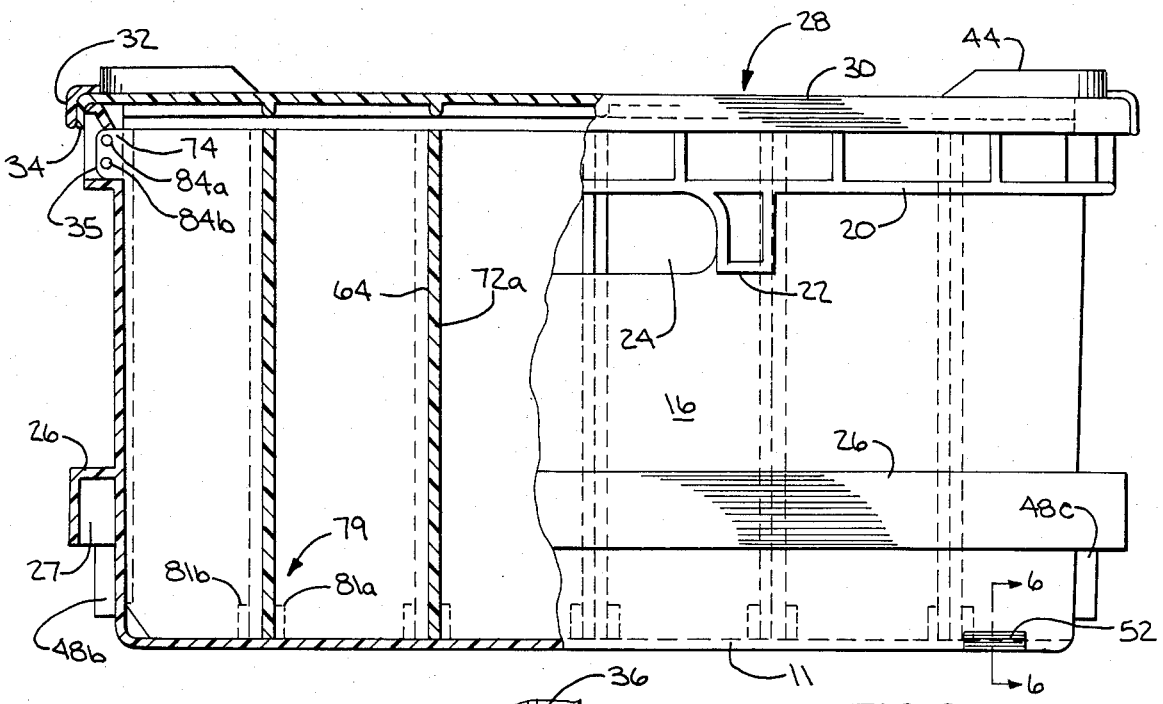
FIG. 2 is a partially cut away end view of the tote box of FIG. 1.

An "L"-shaped bumper rim 26 is integrally molded with the outer face of each of the side walls 12 and 14 and the end walls 16 and 18 to circumscribe the periphery of the tote box below rim 20. As best illustrated in FIG. 2, the bumper rim 26 extends outwardly from the tote box by a distance greater than the outward extension of rim 20 so that only the bumper rim 26 abuts the bumper rim of a like tote box should two tote boxes come into contact with one another. To afford additional strength to the bumper rim 26, ribs 27 are each integrated to the inner surface of the top portion of the bumper rim and to the tote box wall. In practice, the distance between bumper rim 26 and the bottom surface of tote box bottom wall 11 is substantially less than the total height of the tote box side walls 12 and 14 and end walls 16 and 18. It is preferable that the height of the bumpers remain the same regardless of box height, to facilitate automated handling as noted above. The relatively short height of the bumper rim in comparison with the height of rim 20 is very advantageous as the short height of the bumper rim 26 serves to reduce the moment arm created when the tote box is impacted by a like tote box as may occur when the tote boxes accumulate at the conveyor entrance or exit of an automated storage and retrieval system.

The opening into the tote box 10 is typically sealed by way of a separate, detachable lid or cover 28 so as to prevent water and dirt from entering the tote box as well as removal of articles from the tote box when the lid is in place. However, the lid 28 need not always be used with the tote box. As illustrated in FIGS. 1 and 2, the lid 28 is comprised of a sheet 30 of plastic having an integrally molded, depending skirt 32 which circumscribes the outer periphery of rim 20 when the lid 28 overlies the opening into the tote box 10. Sheet 30 is made planar so that water does not tend to accumulate on the lid. Spaced inwardly from the corners at one edge of the lid are a pair of hooks 34 which, as best illustrated in FIGS. 2 and 8, extend inwardly from the skirt 32. Openings 35 are provided in rim 20 so that the hooks seat in the rim openings when the lid is set upon the rim 20. Referring now to FIG. 8 exclusively, once lid 28 is seated on rim 20 so that the hooks 34 seat in the rim openings 35, the hooks 34 restrain lifting of the lid end.

At the end of the lid 28 opposite from hooks 34 is a passageway 36. When the lid is set upon rim 20, the passageway 36 in the lid communicates with a like sized passageway 37 vertically extending through the rim 20 running along wall 18. The communicating passageways 36 and 37 receive a security tie 38 which secures the lid to the tote box. The combination of the hooks 34 and the security tie 38 running through lid passageway 36 and rim passageway 37 is usually sufficient to assure firm engagement of the lid with the tote box. However, to enable the lid 28 to be secured to the tote box in the event that the hooks 34 become broken, a second lid passageway 39 is provided between hooks 34 for communication with a second passageway 40 through the rim 20 running along wall 16. When hooks 34 are broken, the additional lid passageway 39 and rim passageway 40 enable the end of the lid which would normally be secured by hooks 34, to be secured by a security tie (not shown). Thus, the cover remains usable even if the hooks are broken. It should be noted that the openings 37 and 40 are the only openings in the rim 20 and that they do not lead into the interior of the box.

Returning to FIG. 1, corner rails 44 extend upwardly from each of the four corners of lid 28. In practice, each of corner rails 44 is integrally molded with cover 28. The area bounded by the corner rails is slightly larger than the area of bottom wall 11 of the tote box. Thus, when a like tote box is stacked upon the lid 28 of an underlying tote box, the lid corner rails restrain the stacked tote box.

Figure 7:
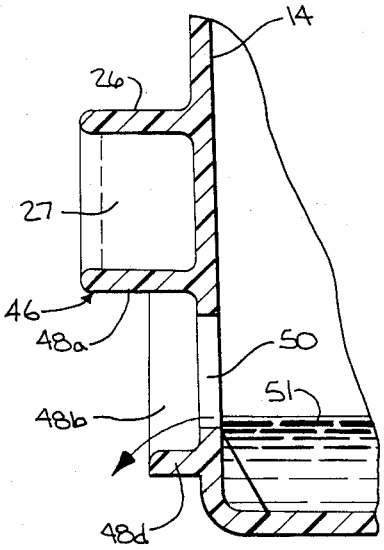
FIG. 7 is a partial cross sectional view taken along lines 7—7 of FIG. 1 illustrating the details of the drain slot which extends through the stacking stop on the tote box.

The stacking of tote boxes one on top of the other is very desirable since it reduces the amount of floor space required. To enable an upper tote box to be supported by a lower box, even when there is no lid, tote box 10 of FIGS. 1, 2 and 7 is provided with outwardly extending stacking stops 46 for engaging the upper rim of a like tote box stacked therebeneath. Each of stacking stops 46 is configured of a pair of spaced apart, vertical walls 48*c* and 48*b* which each are integral with and extend outwardly from the tote box wall. The upper edge of each vertical wall such as wall 48*b* is integral with the bottom end edge of a horizontal wall 48*a* which is integrated at its forward corners to the vertical leg of the bumper rim 26 and along its rear edge to the tote box wall as best illustrated in FIG. 7, the vertical leg of the rim 26 being eliminated across the stop 46 to allow the wall 48*a* to be molded. The lower edge of each of vertical walls 48*c* and 48*b* is integral with each of the end edges of horizontal wall 48*d* which is integral with and extends outwardly from the tote box wall parallel to the horizontal wall 48*a*. The integration of the stacking stop walls with the tote box wall and with the bumper rim affords significant strength to the stop, reducing the likelihood of breakage.

Although likelihood of water accumulating in the tote box may be remote, nonetheless, it is desirable to provide the tote box with a drain passageway so that any accumulated water may exit the tote box to prevent toppling of a column of stacked tote boxes, or system damage, as a result of accumulated water. Conventional wisdom would suggest that any such drain outlet be provided through tote box bottom wall 11 so that all of the water in the tote box would be drained therefrom. However, locating such drain opening in the bottom wall 11 of the tote box would result in the water from the tote box on top of the stack flowing into the tote box beneath it and so on. Thus, while the top tote box on the stack would be drained, the remaining tote boxes in the stack would become full of water which may cause the stack of tote boxes to topple because of the increased weight due to accumulation of water in the lower boxes, or damage to the contents of several boxes.

To provide a mechanism for draining the tote box while avoiding the possibility of water draining from one tote box into a lower tote box, at least one drain slot 50 (FIG. 7) is disposed through one of the tote box walls 12, 14, 16 and 18 so as to lie within the area bounded by the walls 48*a*, 48*b*, 48*c* and 48*d* of the stacking stop 46. Referring now to FIG. 7, when the level of accumulated water 51 within the tote box 10 reaches the level of drain slot 50, then the water flows out of the tote box via the drain slot. The location of drain slot 50 within the area bounded by the walls of the stacking slot (only walls 48*a*, 48*b* and 48*c* being illustrated in FIG. 7) is desirable since the walls of the stacking stop 46 form a rectangular trough for carrying the water far enough away from the tote box so that no water leaks into a lower tote box within the stack of tote boxes.

Figure 6:
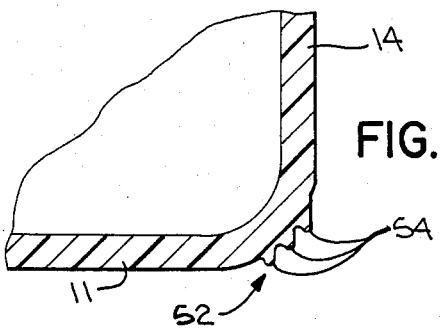
FIG. 6 is a partial cross sectional view taken along lines 6—6 of FIG. 2 to illustrate the traction lugs on the bottom of the tote box.

The outside surface of the bottom wall 11 is preferably conventionally roughened to provide better traction on a conveyor belt. Another feature of tote box 10 which facilitates its use, particularly within an automated storage and retrieval system with multiple, relatively inclined conveyor runs, is the addition of traction lugs 52 as best illustrated in FIG. 2. The traction lugs 52 are located at the corners of the tote box bottom wall and serve to provide proper traction when, for example, a box on a horizontal run comes to an upwardly inclined run. Referring now to FIG. 6, each traction lug 52 takes the form of a plurality of ribs 54 which are molded to and depend from the edge of the bottom wall 11.

While the tote box 10 described thus far is eminently well suited for carrying articles of differing sizes, in many instances it is desirable to provide separate compartments within the tote box interior for retaining very small articles. To this end, a divider grid such as divider grid 60 of FIG. 1 is inserted within the tote box interior to subdivide the tote box interior into smaller compartments. The improved divider grid 60 of the present invention is comprised of a plurality of spaced apart lengthwise divider plates 64 and spaced apart crosswise divider plates 66, each crosswise divider plate 66 being perpendicular and intersecting with each of the lengthwise divider plates 64. As will become clear hereinafter, the improved divider grid not only serves to segregate and compartmentalize small parts, the grid also serves to strengthen the box walls.

Referring now to FIG. 4, each of the crosswise divider plates 66 is "Z"-shaped, having a central portion 70 and a pair of ribs 72*a* and 72*b* which each protrude normally from each end of the body portion 70 that the ribs extend in opposite directions. The "Z" shape of the divider plate allows the plate to be inserted with either end adjacent to the tote box wall, and also allows a group of plates to be more efficiently and compactly stacked for shipping. The bottom edge 73 of each of ribs 72*a* and 72*b* is arcuate so that the divider plate may be inserted more easily within the tote box. Each of a pair of mounting tabs 74 extend outwardly from each of the top lateral edges of the body portion 70. As will become clear by later reference to FIGS. 1, 3 and 9, the mountings tabs 74 serve to secure the divider grid in the tote box.

The crosswise divider plates have mounting slots 76 cut vertically into the bottom of the body portion 70 so as to be in parallel, spaced apart relationship with one another. At the opening of each slot 76 are a pair of opposing bosses 77*a* and 77*b* which restrict the slot opening. On the top edge of the plate 66 opposite each slot 76 is a separate one of notches 78. The function of bosses 77*a* and 77*b* and notches 78 will become better understood following a discussion of the divider plate 64. Each of the lengthwise divider plates 64 is identical to the crosswise divider plates 66 with the exception that the mounting slots 76 of the lengthwise divider plates are cut into the top of the divider plate body portion rather than into the bottom of the divider plate body portion as is the case with the crosswise divider plates. Likewise, the notches 78 in the lengthwise divider plate are cut into the bottom edge rather than the top as is the case with divider plate 66. Both divider plates 64 and 66 are manufactured of molded plastic although different materials could be employed.

To assemble divider grid 60 from a quantity of lengthwise divider plates 64 and crosswise divider plates 66, the crosswise divider plates 66 are mated with the lengthwise divider plates 64 by inserting the appropriate bottom slot 76 of a crosswise divider plate 66 into the associated top slot 76 of a lengthwise divider plate 64 so that each crosswise plate 66 is perpendicular to a lengthwise plate 64 as shown in FIG. 5. When a lengthwise divider plate 64 is mated with a crosswise divider plate 66 so that the slots 76 on each plate fully seat in the slots of the intersecting plate, then the bosses 77*a* and 77*b* at the mouth of each plate slot 76 seat in the notch 78 in the edge of the intersecting plate to firmly lock the plates together. As can be appreciated from FIG. 1, the spacing between the mounting slots 76 on the lengthwise and crosswise divider plates, as well as the number of lengthwise and crosswise divider plates utilized to construct the divider grid 60, will determine the number of separate compartments of the divider grid as well as the volume of each compartment.

Figure 3:
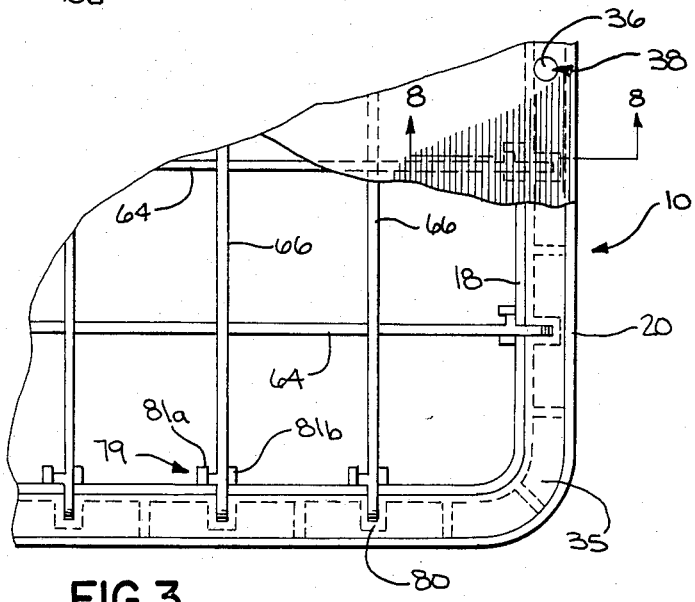
FIG. 3 is a partial plan view of the tote box of FIG. 1 showing the lid cut away.

The divider grid 60 is retained within the tote box 10 by way of guides 79 on the tote box bottom wall 11 and slots 80 cut through the rim 20 at the top of tote box walls 12, 14, 16 and 18. Each of guides 79 is comprised of a pair of spaced apart triangular projections 81*a* and 81*b* which extend upwardly from the tote box bottom wall 11 and outwardly from the tote box walls 12, 14, 16 and 18. The spacing between the projections 81*a* and 81*b* of each of guides 79 is slightly larger than the total width of the rib and the divider plates. The guides 79 are spaced apart from each other by a distance equal to the spacing between the mounting slots on the divider plates and the guides 79 are so located on the bottom and side and end tote box walls that when the divider grid is received within the tote box 10, each rib on each divider plate is received between the projections 81*a* and 81*b* of a separate one of guides 79 as best illustrated in FIG. 3. When the divider grid 60 is received within the tote box, the ribs 72*a* and 72*b* on the divider plates 64 and 66 each bear against a tote box wall to impart additional rigidity to it. Since the projections 81*a* and 81*b* of each guide 70 are spaced wide enough to accommodate both the divider plate thickness and rib thickness, the likelihood of dirt and grime becoming trapped between the guide projections is reduced.

The slots 80 in the rim 20 are spaced apart a distance equal to the spacing between the slots 76 on each of divider plates 62 and 66. Each of slots 80 lies along the center line between each of the projections of guides 81*a* and 81*b* for receiving one of the mounting tabs 74 extending outwardly from each of the divider plates in the same major plane. Referring now to FIGS. 1 and 9, each slot 80 is provided with an overlying integral inclined ramp 82. The ramp 82 guides the tab 74 into the slot 80 and the walls and ramps have enough resilience to allow the tabs 74 to snap past the ramps 82 and seat in the notches 80 as shown in FIG. 9. Once the divider plate tab clears the ramp 82 to seat in the slot 80 below the ramp, then the ramp 82 overhangs the divider plate tab 72 to lock the divider grid in place. Thus, the divider plate tabs are "snapped" into the slots 80. Referring now to FIG. 4, each mounting tab on each divider plate has a pair of outwardly projecting nubs 84*a* and 84*b*. The nubs 84*a* 84*b* on each divider tab of each divider plate frictionally engage in the sides of each slot 80 when the divider grid is received in the tote box to insure that the divider plates are not easily removed from the tote box once they have been inserted.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

What is claimed is:

1. An improved tote box especially suited for use in an automated storage and retrieval system comprising:

a bottom;

opposing side and end walls each extending upwardly from said bottom;

a bumper rim located a distance up from said bottom which distance is substantially less than the total height of said side and end walls and extending outwardly from the exterior of each of said side and end walls so as to substantially circumscribe the periphery of said box; and a plurality of stacking stops each including a horizontal top wall integrated with said bumper rim and extending outwardly from one of said side and end walls, a pair of generally vertical end walls each integrated to said top wall and each having a rearward edge integrated with said one of said side and end walls and a generally horizontal bottom wall integrated at each of its ends to a corresponding vertical end wall and integrated at its rearward edge to said one of said side and end walls to project horizontally therefrom, said bottom wall being spaced above the bottom of the tote box and providing a contact area for abutting the upper edge of a corresponding one of said opposing side and end walls of a like tote box when the boxes are stacked one on top of another, the portion of the box below the bottom walls of the stacking stops then being received in the lower box to limit relative horizontal movement.

2. The invention according to claim 1 further including a drain opening disposed through the area bounded by said top, end and bottom walls of said stacking stop for providing a channel to carry water from the interior of said box.

3. The invention according to claim 1 further including an upper rim circumscribing the top edge of said side and end walls, said upper rim extending outwardly from said tote box side and end walls by a distance less than the extension of said bumper rim.

4. The invention according to claim 1 further including an intersecting divider plate grid receivable within said tote box for subdividing the tote box into smaller compartments, said divider grid comprising:

a plurality of crosswise divider plates, each crosswise divider plate comprised of a central body portion having a plurality of mounting slots in the bottom thereof and a plurality of notches in the top so as to be in alignment with the slots, each of said slots having a pair of opposing bosses at its mouth for engaging the notch of an intersecting lengthwise divider plate; and a plurality of lengthwise divider plates, each lengthwise plate comprised of a central body section having spaced apart notches in the bottom thereof and spaced apart slots in the top thereof for mating with a bottom mounting slot on one of said crosswise divider plates, each slot having a pair of opposing bosses at its mouth for engaging the notches of an intersecting crosswise divider plate.

5. The invention according to claim 4 wherein said tote box is provided with spaced apart slots in the box side and end walls, each tote box slot having an overlying inclined ramp and each of the crosswise and lengthwise divider plates is provided with a pair of mounting tabs each extending from each of the edges of said plates and in the same major plane, said tabs being seatable in the tote box slots and retainable by the ramps overlying each tote box slot.

6. The invention according to claim 5 wherein each said mounting tab of each said divider plate has at least one outwardly extending nub for frictionally engaging a side of said tote box slot.

7. The invention according to claim 1 further including a divider grid wherein said divider grid comprises intersecting lengthwise and crosswise divider plates, each of said intersecting divider plates being "Z"-shaped, having a central body portion and vertically disposed flanges at each end of said central body portion, each of said flanges extending outwardly from said central body portion in a direction opposite to the other flange; the central body portion of each divider plate having spaced apart notches at one end and spaced apart mounting slots at the other for mating with the mounting slots of an intersecting divider plate, each said slot having a pair of opposing bosses at its mouth for seating in the notch of an intersecting divider plate to engage said intersecting divider plate.

8. An improved divider grid for subdividing the interior of a tote box comprising:

a plurality of crosswise divider plates, each crosswise divider plate comprised of a central body section having spaced apart mounting slots in its bottom and spaced apart notches in its top and said central body portion having a pair of flanges, each flange running vertically along, and extending normally from the end of the central body section in a direction opposite to the other of said flanges to impart strength to said plate crosswise;

a plurality of lengthwise divider plates, each lengthwise plate comprised of a central body section having spaced apart notches in the bottom thereof and spaced apart slots in the top thereof for mating with the bottom mounting slots on said crosswise divider plates and said central body section having a pair of flanges each running vertically along and extending normally from the end of said central body section in a direction opposite to the other of said flanges of imparting strength to said crosswise plate;

the mounting slots of each of said lengthwise and crosswise plates each having opposing bosses at its mouth for engaging the notch in the intersecting divider plate; and a tote box having a bottom wall and opposing side and end walls rising upwardly therefrom and provided with spaced apart slots in one pair of said opposing side or end walls, each slot having an inward projecting inclined ramp, and each of the crosswise and lengthwise divider plates being provided with a pair of mounting tabs each extending from each of the edges of said plates for seating in said tote box slots, the ramps being arranged to engage said mounting tabs to snap past and seat in said slot where the ramps overhang said mounting tabs to retain the divider plate within the tote box.

9. The improved divider grid of claim 8 wherein said divider plates are substantially Z-shaped in cross section.

* * * * *